US007252538B2

(12) United States Patent
Garrett et al.

(10) Patent No.: US 7,252,538 B2
(45) Date of Patent: Aug. 7, 2007

(54) TRACER LAMP ARRANGEMENT

(75) Inventors: Rick Garrett, Greenacres, WA (US); Pat Weisbeck, Greenacres, WA (US)

(73) Assignee: Telect Inc., Liberty Lake, WA (US)

( * ) Notice: Subject to any disclaimer, the term of this patent is extended or adjusted under 35 U.S.C. 154(b) by 0 days.

(21) Appl. No.: 11/275,213

(22) Filed: Dec. 19, 2005

(65) Prior Publication Data

US 2006/0286853 A1 Dec. 21, 2006

Related U.S. Application Data

(60) Provisional application No. 60/687,630, filed on Jun. 3, 2005.

(51) Int. Cl.
*H01R 3/00* (2006.01)

(52) U.S. Cl. ..... 439/490

(58) Field of Classification Search ..... 439/490, 439/489, 668, 669
See application file for complete search history.

(56) References Cited

U.S. PATENT DOCUMENTS 5,612,680 A * 3/1997 DeSanto ..... 340/815.45
6,422,902 B1 * 7/2002 Ogren et al. ..... 439/668

* cited by examiner

*Primary Examiner*—Khiem Nguyen
(74) *Attorney, Agent, or Firm*—Lee & Hayes, PLLC

(57) ABSTRACT

Embodiments of a digital cross-connect panel with tracer lamps for identifying telecommunications circuits are presented herein.

15 Claims, 5 Drawing Sheets

TRACER LAMP ARRANGEMENT

RELATED APPLICATIONS

The present application claims priority under 35 U.S.C. § 119 to U.S. Provisional Application Ser. No. 60/687,630 filed Jun. 3, 2005, to Garrett et al and titled "Tracer LED Placement", the disclosure of which is hereby incorporated by reference in its entirety.

BACKGROUND

Digital signal cross-connect equipment plays a vital role in the installation, monitoring, testing, restoring and repairing of digital telecommunication networks. Digital signal cross-connect panels are frequently used in digital networks to provide a central cross-connect location that is convenient for testing, monitoring, restoring and repairing infrastructure equipment associated with the communication of digital signals. Digital signal cross-connect panels are frequently used in a variety of locations, such as telephone central offices, remote sites and customer premises. For example, a cross-connect panel may be utilized in the infrastructure to allow circuit arrangement and rearrangement by plugging and unplugging cabling from jacks disposed on the "front" of the cross-connect panel.

However, because of the vast number of devices utilized to communicate, an equally and even greater number of connections may be utilized in the telecommunication infrastructure to provide communication between the devices, such as through the use copper, fiber, and optical cabling. Therefore, routing and organization of this cabling when configuring and rearranging the infrastructure may be difficult. In particular, it may be difficult to identify where a particular cable is routed.

In the past, one technique used to identify routed cabled involved a technician manually tracing cabling to determine equipment interconnections. This technique was difficult, frustrating, and time consuming for the technician.

Another previous technique required the technician to apply a test voltage at one location, e.g., at one cross-connect panel. Then, at the site of another cross-connect panel (which may be located at a significant distance from the destination), the technician located a corresponding jack through use of a plug that was sequentially inserted into each of the jacks until a jack having the test voltage was located. This was also both time consuming and frustrating to the technician, especially as the number of cables and distance between locations increased.

SUMMARY

Implementations of a digital cross-connect panel are described which provides a tracer lamp to visually identify telecommunications circuits formed via the panel. In an implementation, the digital cross-connect panel provides tracer lamps disposed between jacks configured to provide access to a respective telecommunication circuit. Tracer lamps may be used to identify where in telecommunication infrastructure cabling is routed and/or connected. For instance, a first network element and a second network element may be connected respectively to different digital cross-connect panels. Interconnections of the respective digital cross-connect panels may form a telecommunications circuit between the two network elements. A tracer lamp on each cross-connect panel associated with a circuit may light up when the jacks are utilized to access the circuit. In another implementation, tracer lamps are provided on a digital cross-connect panel having a height of one rack unit (RU) or less, which corresponds to a height of less than 1.75 inches.

DETAILED DESCRIPTION

It should be noted that the following devices are examples and may be further modified, combined and separated without departing from the spirit and scope thereof.

Figure 1:
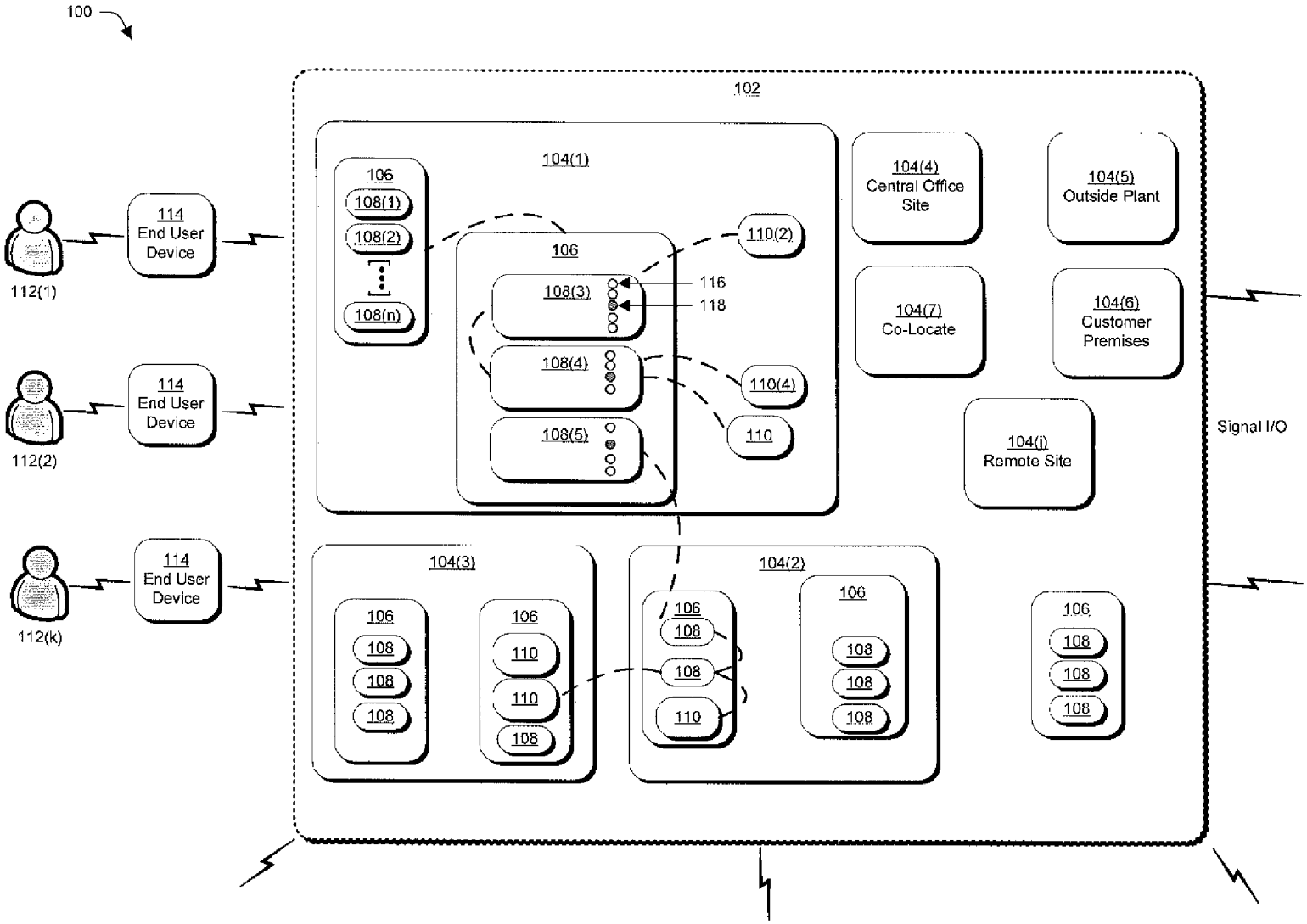
FIG. 1 is an illustration of an environment having a portion of a telecommunications infrastructure in which a digital cross-connect panel may be employed.

FIG. 1 illustrates an exemplary implementation of an environment 100 operable to provide a telecommunications network in which the apparatuses and procedures of the present disclosure may be employed. The environment 100 includes at least a portion of a telecommunication network infrastructure 102 (hereinafter "infrastructure"). Infrastructure 102 provides telecommunications processes, structures, equipment and devices between end-user devices such as modems, phones, and so on used by end-users outside of the infrastructure 102 to communicate via a telecommunications network. Within infrastructure 102 a variety of equipment, apparatus and devices are utilized in routing, processing, and distributing signals. Telecommunications signals and data may among other actions be processed, switched, routed, tested, patched, managed, or distributed by various equipment in the infrastructure 102.

A variety of sites 104(1)-104(j) within infrastructure 102 may maintain various equipment used in the infrastructure 102, where "j" may be any integer from one to "J". As depicted in FIG. 1, infrastructure 102 may have numerous sites 104 which may be different physical locations within infrastructure 102 such as a central office, an outside plant site, a co-locate site, a remote site, or customer premises. Sites 104 may be locations within infrastructure 100 which hold a variety of structures and equipment to facilitate processing and distributing of telecommunications signals. The equipment may be centralized in one site (e.g., site 104(1)) or dispersed throughout different sites 104 in infrastructure 102. In other words, interconnections may be made between various sites 104 in infrastructure 102, for example the connection denoted in FIG. 1 by a dashed line between site 104(1) and 104(2). Naturally, numerous interconnections between a plurality of sites 104 typically may be made.

Each site 104 may have one or more housings 106 having a plurality of components 108. A housing refers to a structure to maintain or hold a plurality of components 108 in infrastructure 102 and may be configured in a variety of ways. For example, the housing 106 may be configured as a housing for a cabinet, a terminal block, a panel, a protector block, a chassis, a digital cross-connect, a switch, a hub, a rack, a frame, a bay, a module, an enclosure, an aisle, or other structure for receiving and holding a plurality of components 108. Hereinafter, the terms housing and cabinet will be used for convenience to refer to the variety of structures in infrastructure 102 that may hold components 108. Housings 106 may be inside a building or housings may themselves be configured to be placed outside, e.g. an outside plant cabinet. Housings 106 may typically be configured to protect components 108 from environmental influences. The environment 100 of FIG. 1, for instance, depicts site 104(1) as having two housings (e.g., cabinets) 106, each having a plurality of components 108. Other housings 106 may be included throughout infrastructure 102 at sites 104, for example housings 106 depicted within site 104(2).

Components 108 are pieces of telecommunications equipment in infrastructure 102 that may be kept or maintained in a housing 106 (e.g., a cabinet) within the infrastructure 102. Components for example may be cross-connect panels, modules, terminal blocks, protector blocks, chassis, backplanes, switches, digital radios, repeaters and so forth. Generally, components 108 may be those devices utilized for processing and distributing signals in infrastructure 102 and which may be maintained in a housing 104. Components 108 may also be used to manage cabling in infrastructure 102. Components 108 may terminate, interconnect and/or cross-connect a plurality of network elements 110 within infrastructure 102.

"Terminating" generally refers to connecting a network element 110 at a particular connection point (e.g., termination or connector) of a component 108 on a permanent or semi-permanent basis. These connections are not intended to be regularly changed, although certainly the connections may be changed. Thus, the location of the network element 110 becomes associated at the particular connection point of the component 108, and may remain fixed at that location during normal operations for long periods of time. The network element 110 is then referred to as "terminated" at the component 108. Interconnections of the components 108 may then be formed by additional connection points to provide signal pathways between the terminated network elements 110. These additional interconnections are more readily modified, such that the network elements 110 terminated at various components 108 may be interconnected in many different configurations. This permits redundancy and flexibility in a telecommunications infrastructure 102, without requiring major rearrangements of equipment, network elements 110, and so forth, to reconfigure, maintain, or test the network.

Components 108 may be utilized to distribute telecommunications signals sent to and from infrastructure 102 by one or more end-users 112 using an end-user device 114. The interconnections between telecommunications equipment (e.g., cabinets 106, components 108 and network elements 110) provide signal pathways for telecommunications signals. Interconnection may be via one or more components 108 such as by connectors or terminations disposed on a component, or may be internal to the components 108 such as via cabling within a component 108. Representative interconnections are shown by dashed lines in FIG. 1 and numerous interconnections within and between telecommunication equipment are typical.

Network elements 110 may be implemented in a variety of ways. For example, network elements 110 may be configured as switches, digital cross-connect system (DCS), telecommunication panels, terminal blocks, protector blocks, digital radios, fiber optic equipment, network office terminating equipment, and any other telecommunication equipment or devices employed in a telecommunications infrastructure 102. It is noted that one or more of the components 108 within a cabinet 106 may also be a network element 110. In other words, network elements 110 may be found within a cabinet 106 as component 108 of the cabinet. Thus, in a particular cabinet 106 interconnections may be between network elements 110 externally (e.g., not in the same cabinet) or internally (e.g., within the same cabinet). Naturally, internal and external interconnections may be mixed such that a single cabinet 106 will have both internal and external interconnections. Further, such connections for a particular cabinet 106 might be made wholly within a particular site 104. Interconnections may also be made between a plurality of sites 104.

The environment 100 depicts a plurality of end users 112(1)-112(k), where "k" may be any integer from one to "K". End users 112(1)-112(k) may be communicatively coupled, one to another, via a telecommunication network including infrastructure 102. End users 112 may be implemented in a wide variety of ways, such as consumers, business users, internal users in a private network, and other types of users that use telecommunications signals or transmit and receive telecommunications signals. Additionally, for purposes of the following discussion clients 112(1)-112(k) may also refer to client devices and software which are operable to transmit and receive telecommunications signals. Thus, clients 112(1)-112(k) may be implemented as users, software and devices.

The interconnection of pieces of equipment (e.g., cabinets 106, components 108 and network elements 110, and so forth) provides signal pathways between equipment for signals input to and output from infrastructure 102. For example, end-users 112(1)-112(k) may send signals into the infrastructure 102 and receive signals output from the infrastructure using a variety of end user devices 114. A telecommunication circuit is formed by the interconnection of least two pieces of equipment, one to another. For instance, the interconnection (e.g., cross-connection) of at least two network elements 110 terminated at one or more components 108 forms a telecommunication circuit. Using one or more of the variety of circuits formed in telecommunications infrastructure 102, end user 112(2) may communicate with end user 112(k) via end-user device 114 (e.g., a telephone). Thus, signals sent to and from infrastructure by end-users 112 via an end user device 114, may be routed directed, processed, and distributed in a variety of ways via the equipment and interconnections (e.g., circuits) within infrastructure 102.

In an implementation, a cabinet 106 has a plurality of components 108 to connect numerous lines. A cabinet 106 may have a plurality of components 108 configured as digital cross-connect (DSX) panels, as depicted in FIG. 1 by DSX panels 108(1), 108(2), . . . , 108(n), where "n" may be any integer from one to "N". DSX panels 108(1)-108(n) provide modular connection points within a cabinet 106 between various network elements 110 such as switches, cross-connects, terminal blocks, protector blocks, other panels and so forth. Thus, a DSX panel 108 may be used to provide interconnections and terminations for network elements 110, to form a plurality of telecommunications circuits, and provided a centralized location for testing and patching a variety of signal pathways in telecommunication infrastructure. Typically a circuit is formed between two network elements 110 terminated at different respective DSX panels 108. Naturally, telecommunication circuits may be formed between network elements 110 at the same DSX panel 108 as well. DSX panels 108(1)-108(n) may operate to provide a variety of functions. For instance, DSX panels 108(1)-108(n) are typically configured to: terminate a plurality of network elements 110, to provide cross-connect or interconnect of terminated network elements 110 thereby forming a plurality of telecommunication circuits, and to provide one or more access to the circuit for monitoring, testing, patching an so forth.

For example, each of DSX panels 108(3) and 108(4) is depicted in FIG. 1 as connected respectively to network elements 110(2) and 110(4). Further an interconnection is depicted between DSX panels 108(3) and 108(4). In an implementation, a telecommunication circuit is formed between network elements 110(2) and 110(4) by the interconnection of DSX panels 108(3) and 108(4). Naturally, numerous telecommunications circuits may be formed within infrastructure 102, and with a single DSX panel 108. Further discussion of the operation of DSX panels 108 may be found in relation to FIGS. 2 to 4 below.

In implementation, A DSX panel 108 may be configured to provide access to a plurality of telecommunication circuits formed by interconnections of network elements 110 terminated at the panel. Access generally refers to monitoring, cross-connecting, testing and patching of circuits in telecommunications infrastructure. In an instance, access may be provided by a plurality of jacks such as representative jacks 116 depicted in FIG. 1. DSX Panels 108(3), 108(4) and 108(5) located in site 104(1) of FIG. 1 are each depicted having a plurality of jacks 116 to provide access to respective circuits. Although only one set of jacks is depicted for each DSX panel, each panel may have a plurality of sets of jacks 116. Each set of jacks 116 provided is associated with a circuit and provides access to the circuit, e.g., for monitoring, testing and/or patching. Further discussion of the operation and arrangement of jacks 116 may be found in relation to FIGS. 2 to 4 below.

In addition, DSX panels 108(1)-108(n) may provide tracer lamps 118, such as representative tracer lamps 118 depicted on DSX panels 108(3), 108(4), and 108(5). Tracer lamps are provided for visual "tracing" of signal pathways which may aid in identifying which particular equipment is involved in forming a telecommunications circuit. Thus, tracer lamps may be used for identifying and managing network elements 110 and associated circuits. For instance, both panels 108(3) and 108(4) are depicted having a respective tracer lamp 118 which may correspond to the circuit formed between network elements 110(2) and 110(4). The tracer lamp 118 on each DSX panel 108(3), 108(4) may "light-up" when a technician accesses the circuit, via a Jack 116 of either DSX panel 108(3), 108(4). In this manner, a technician may be provided a visual indication of where the panels, network elements, signal pathways and so forth associated with the circuit are located within telecommunications infrastructure 102. In other words, the technician may see where both ends of the circuit are located (e.g., which DSX panels 108 and which locations the network elements 110(2) and 110(4) are terminated).

In an implementation, tracer lamps 118 are arranged to permit low profile DSX panels 108. For example, tracer lamps may be provided in a DSX panel having a height of one rack unit (RU) or less. One rack unit (RU) corresponds to a 1.75 inch high DSX panel. In an implementation, tracer lamps 118 are arranged on the DSX panel 108 as between jacks 116 on the DSX panel 108, thereby optimizing space and permitting a lower profile DSX panel 108. Further discussion of tracer lamp operation and arrangements may be found in relation to FIGS. 2-4.

Figure 2:
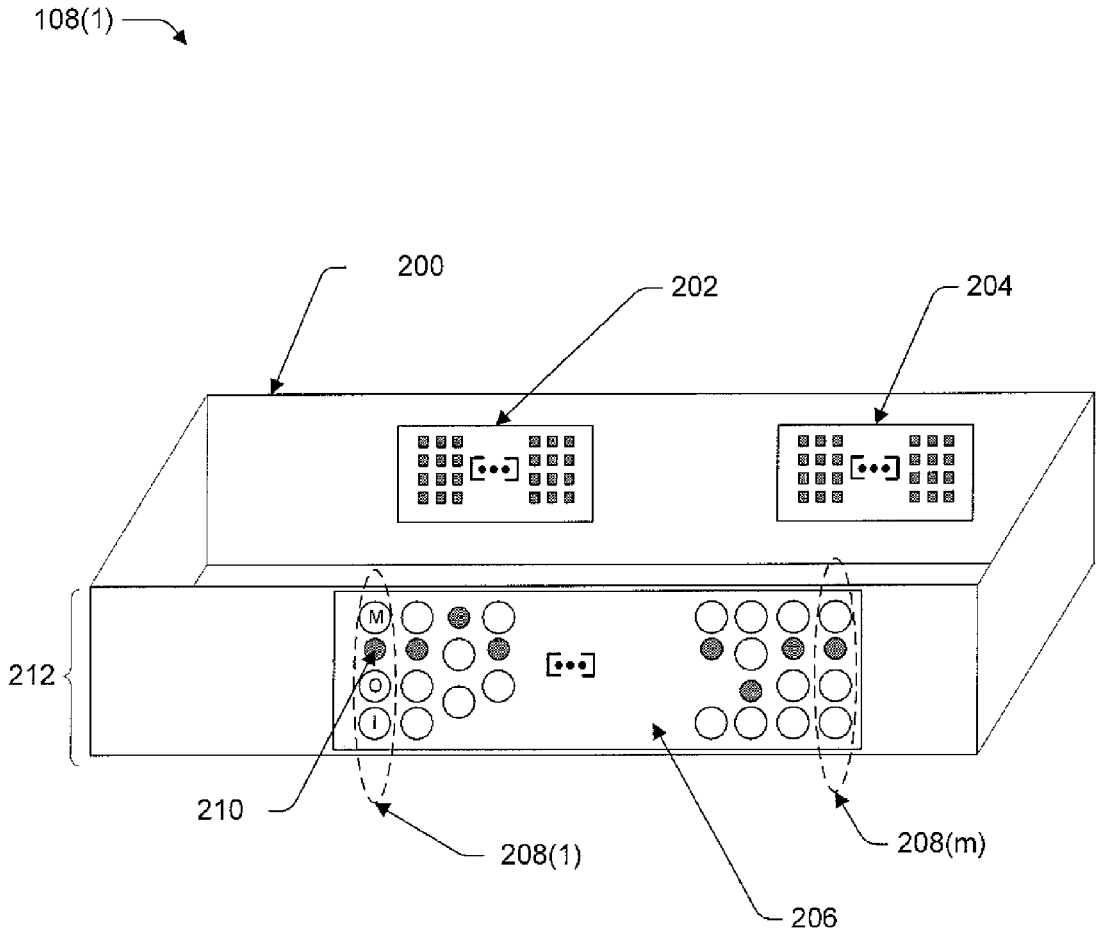
FIG. 2 illustrates an exemplary implementation of a digital cross-connect panel of FIG. 1 in greater detail.

FIG. 2 depicts an exemplary panel 108(1) of FIG. 1 in greater detail. Panel 108(1) includes a chassis 200. Chassis 200 may be configured in a variety of ways to provide terminations, cross-connections, and jack access to a plurality of network elements, such as the network elements 110 depicted in FIG. 1.

Chassis 200 includes a first array of termination 202, which may be used to terminate a plurality of network elements 110 at DSX panel 108(1). Terminations 202 provide interconnection points in a DSX panel 108(1) for signals pathways into and out from the DSX panel 108(1), e.g., to transmit and receive signals. The chassis 200 is depicted having an array of terminations 202 disposed upon at least one surface of chassis 200 such that the terminations 202 extend through chassis 200 and are supported by the chassis. A plurality of individual terminations 202 may be used to terminate a single network element 110 at a DSX panel 108(1).

The number of terminations 202 disposed on chassis 200 may vary as denoted in FIG. 2 by the symbol [ . . . ] in the termination array 202. A DSX panel 108(1) may be designed to accommodate a particular number of circuits for instance 8, 24, 64, 128 and so forth. Typically, the number of terminations 202 corresponds to the number of circuits a DSX panel 108(1) is designed to accommodate.

Terminations 202 may be configured in a variety of ways, such as single post pins, bifurcated pins, insulation displacement connectors, screw terminals and so forth. It is also noted that one or more connectors may be used in lieu of, or in conjunction with the terminations 202 to provide connections to network elements 110. The connectors may be for instance standard 50 pin or 64 pin connectors, amphenol style connectors, or other connectors suitable for interconnection equipment in a telecommunication infrastructure 102.

Chassis 200 is depicted in FIG. 2 to include a second array of terminations 204 which provides interconnections (e.g., cross-connections) between network elements 110 terminated at the DSX panel 108(1), and other network elements 110, for instance at another DSX panel 108. Again, these terminations 204 may be configured in a variety of ways, such as single post pins, bifurcated pins, insulation displacement connectors, screw terminals and so forth. Also, standard connectors may be used in lieu of or in place of terminations 204. As with terminations 202, the number of terminations 204 disposed on chassis 200 may vary as the denoted in FIG. 2 by the symbol [ . . . ] in the termination array 204 of FIG. 2.

Although FIG. 2 depicts terminations 202 and 204 upon a single surface of chassis 200, in other implementations terminations 202 and 204 may also be disposed on multiple surfaces of chassis 200. In addition, a single set of terminations 202 (or connectors) may be used to perform both terminations and interconnections.

It is noted that DSX panel may be configured to carry a variety of signal types. In one implementation, the DSX panel is configured for Digital Service, Level 1 (DS1) signals. DS1 signals have a rate of 1,544,000 bits per second (1.544 megabits per second (Mbps)). A DS1 signal may be carried on a T1 signal pathway, which typically includes two pairs of twisted cabling. One twisted cable pair carries a DS1 signal in one direction and another twisted cable pair carries a DS1 signal in the opposite direction, (e.g., input/output to and from a network element 110).

In another implementation, the DSX panel is configured for a higher rate signal of 44,736,000 bits per second (44.736 Mbps), which is known as Digital Service, Level 3 (DS3). A DS3 signal is carried on a T3 digital signal pathway, which may include a pair of copper coaxial cables, fiber optics or RF transmission and so forth.

In an implementation, DSX panel 108 may be configured for a variety of ethernet signals. Ethernet signals may have a variety of rates, such as 10 Mbps (10Base-T Ethernet), 100 Mbps (Fast Ethernet), 1000 Mbps (Gigabit Ethernet) and so forth. Further, the various ethernet signals may be carried by a variety of corresponding cabling, such as category 5 (CAT 5), category 6(CAT 7) and/or category 7(CAT 7) cabling.

Although DS1, DS3 and Ethernet signals have been described, it is contemplated that other signal rates and types may be employed without departing from the spirit and scope thereof. In addition, various signal rates may be combined in a single DSX panel. For example, a DSX panel 108 may provide some DS1 signal pathways and some DS3 signal pathways.

In an implementation, DSX panel 108(1) includes an array of jacks 206 which may be used to test, interconnect and patch network elements 110 terminated at the DSX panel 108(1) and their associated circuits The plurality of jacks 202 are may be communicatively coupled through panel 108(1) to circuits formed via the panel 108(1). For instance, jacks 206 may be communicatively coupled to respective terminations in termination arrays 202 and 204. Thereby, the jacks are configured to provide access to respective telecommunications circuits formed at DSX panel 108(1) for temporary patching during maintenance or redirecting a signal during troubleshooting. Thus, access may include one or more of monitoring, testing, patching, redirecting, cross-connecting, interconnecting, or otherwise utilizing the circuits or signals from the circuits. Access may be intrusive or non-intrusive.

As depicted in FIG. 2 DSX panel 108(1) includes a plurality of sets of jacks 208(1), . . . , 208(m) (where "m" may be any number from two to "M"), arranged in columns in the jack array 206. Each of the jacks in a set may be configured in a variety of ways, such as a monitor jack, an input jack, an output jack, and so forth. Jacks may also be input-cross or output-cross jacks. A monitor jack is used to monitor and test a signal of a network element 110. For example, a monitor jack may be configured to monitor an output signal or an input signal. Output and input jacks are configured to provide access the output and input of a respective network element for patching, cross connecting, or redirecting. The number and function of individual jacks in any set of jacks 208 may vary. A variety of exemplary arrangements of the individual sets of jacks 208 are depicted in FIG. 2. Further, a variety of styles of jacks is contemplated such as bantam jacks, WECO (Western Electronic Company) style, mini-WECO style, modular jacks, registered jack-45 (RJ-45), other registered jack (RJ) style, and so forth.

FIG. 2 also illustrates a tracer lamp 210 associated with each set of jacks 208. A tracer lamp 210 may be configured to illuminate to indicate that a corresponding circuit is being accessed. Illumination may include blinking, "steady on", a combination thereof, and so forth. Tracer lamps 210 may be configured in a variety of ways such as light emitting diodes (LEDs), fluorescent, incandescent, and so on.

In an implementation, a tracer lamp 210 corresponding to one network element of a circuit may be illuminated by insertion of plug into one jack of a corresponding set of jacks 208 to access the circuit. Another tracer lamp 210 associated with another end of the circuit, (e.g., the other connected network element 110) will also illuminate. Thus, a pair of tracer lamps 210 may operate in tandem to identify a circuit interconnection.

In an implementation, chassis 200 with tracer lamps 210 is provided having an associated height 212 of one rack unit (RU) or less. Traditional jack arrangements have placed tracer lamps outside of the jack array which increase the associated height 212 of the DSX panel 108. By tightly arranging jacks and associated tracer lamps in a jack array 206, a more compact DSX panel 108(1) design is achieved. Thus, the height 212 of the DSX panel 108(1) may be minimized. This permits tracer lamps 210 to be provided on a chassis 200 with a height 212 of one rack unit (RU) or less.

In another implementation, the tracer lamps 210 are disposed within the jack array 206 and in particular between jacks in a set or column. In this manner the necessary height 212 may be reduced. By arranging tracer lamps between corresponding 208, (e.g., in the columns 208 depicted in FIG. 2) a higher density, more compact DSX panel 108(1) is attainable, e.g., a DSX panel 108(1) having a decreased height 212 for the same number of circuit terminations.

Figure 3:
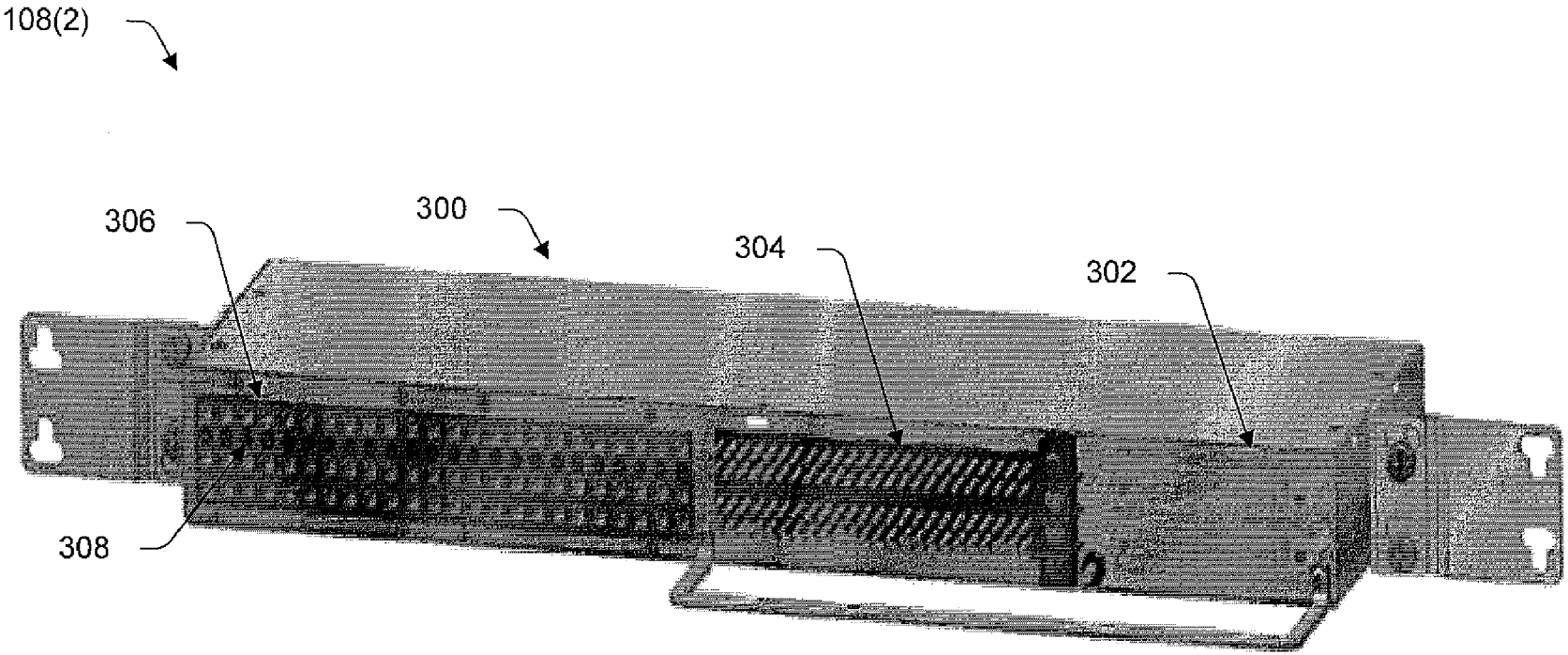
FIG. 3 illustrates another exemplary implementation of a digital cross-connect panel of FIG. 1

FIG. 3 depicts another exemplary implementation of a DSX panel 108(2) of FIG. 1 in greater detail. DSX panel 108(2) is depicted having a chassis 300. A plurality of connectors 302 are disposed on the chassis 300 to terminate network elements 110. Connectors 302 may be configured in a variety of ways, such as pin connectors, amphenol style connectors, and so forth.

An array of terminations 304 is provided on chassis 300 to form interconnections between the terminated network elements 110. For instance, interconnections between various DSX panels 108 depicted in FIG. 1 may be made, thereby forming circuits between respective network elements 110 terminated at the panels 108. A plurality of such circuits may be formed via a DSX panel, such as DSX panel 108(2). For example, DSX panel 108(2) as depicted in FIG. 3 may terminate 24 network elements via connectors 320, and is configured to form 24 corresponding circuits via an array of terminations 304. Naturally, in various other implementations more or less circuit capacity may be provided.

DSX panel 108(2) also includes a jack array 306 having a plurality of sets of jacks. Each set of jacks in the jack array 306 has a corresponding tracer lamp 308. The tracer lamp 308 is disposed in the jack array 306 between jacks in a set. Further discussion of the jack and tracer lamp arrangement of exemplary DSX panel 108(2) is provided in relation to FIG. 4 below.

It is noted that locations of jacks, terminations, connectors and so forth may vary in different implementations of a DSX panel 108 without departing from the spirit and scope thereof For example in FIG. 3 the depicted DSX panel 108(2) is configured to provide access to all the connections from a single side. That is, the jack array 306 jacks, cross-connect terminations 304, and connectors 302 are all on a single side of chassis 300. In other implementations, the jacks, cross-connects and terminations may be arranged in variety of ways, for example divided between the front and back side of chassis 200 as depicted in FIG. 2.

Figure 4:
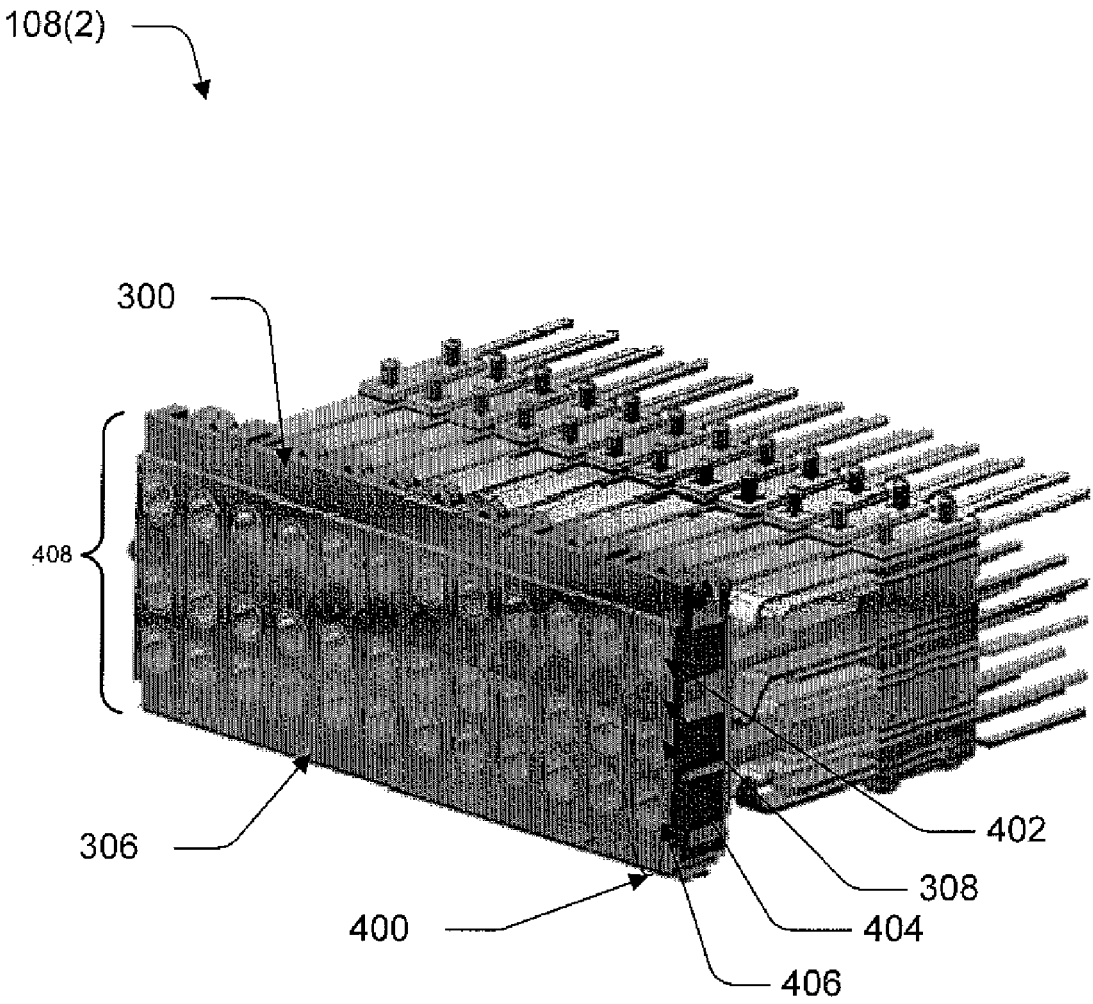
FIG. 4 illustrates a portion of the digital cross-connect panel of FIG. 3 in greater detail.

FIG. 4 depicts a portion DSX panel 108(2) of FIG. 3 showing the jack array 306 in greater detail. The jack array is arranged in a plurality of sets 400. Each set of jacks 400 corresponds to one network element 110 and to a corresponding circuit. For instance, in FIG. 3 DSX panel 108(2) is depicted having 24 sets of jacks, each set corresponding to one network element 110, and one of the 24 circuits which may be formed via the DSX panel 108(2). Accordingly each set of jacks 400 may be configured to provide access to a corresponding circuit. Jacks may be configured as any jack that is suitable for providing module access to telecommunications circuits, such as WECO style, mini-WECO style, bantam, modular jacks, RJ-45, RJ style, and so forth.

Jacks may be arranged in variety of ways. In the implementation in FIG. 4 each set of jacks 400 includes three jacks. In particular the jacks include a monitor jack 402, an output jack 404 and an input jack 406. Monitor jack 402 is configured to provide access for monitoring of a corresponding circuit. The output jack 404 and input jack 406 provide access respectively to the input and output signals of a corresponding circuit. Naturally, different numbers and types of jacks may be employed, in different sets 400, on different DSX panels 108, and so forth.

In the implementation of FIG. 4, tracer lamps 308 are depicted disposed between the monitor jack 402 and the output jack 404 of each set of jacks 400. Naturally a variety of other arrangements of tracer lamp are contemplated, such as having a tracer lamp between an input 406 and output jack 404, between two monitor jacks 402 in the same set 400, and so forth.

FIG. 4 further depicts DSX panel 108(2) having an associated height 408. Arranging tracer lamps 308 between jacks in a set of jacks 400, permits the height 408 to be reduced compared to other arrangements. In this manner, DSX panel 108(2) may have a height 408 corresponding to one rack unit (RU) or less.

In an implementation the tracer lamp 308 is configured to "light-up" or illuminate when an associated jack is used to access a corresponding circuit. For instance, a monitor jack 402 may be used to monitor a circuit corresponding to a particular circuit and to a tracer lamp 308. The lamp 308 may be configured to "light-up" when a plug is inserted in the monitor jack 402 to monitor the circuit, for instance by a technician. In other implementations, the tracer lamps 308 associated with a particular circuit location may be activated in other ways, such as using a different jack (e.g. input rather than monitor), a switch, a button and so forth to cause the tracer lamps to "light-up".

Further, two or more tracer lamps 308 may operate in tandem. Consider a circuit formed by the interconnection of two network elements 110. A tracer lamp 308 may be associated with each network element 110, e.g. on each side of the circuit. The network elements 110 may be terminated at the same or different DSX panels 108. The tracer lamp 308 associated with one side of the circuit works in tandem with another tracer lamp 308 associated with the other side of the circuit. Thus, both tracer lamps 308 associated with a circuit are activated to indicate where in telecommunications infrastructure 102, the circuit is located. Accordingly, a visual indication is provided by the tracer lamps to identify the circuit. In other words, from the tracer lights 308, a technician may understand which DSX panels 108 are associated with the circuit, where cabling associated with the circuit is run, and where the network elements 110 of the circuit are located and/or connected to DSX panels 108.

Exemplary Procedures

The following discussion describes techniques that may be implemented utilizing the previously described systems and devices. The procedures are shown as a set of blocks that specify operations performed and are not necessarily limited to the orders shown for performing the operations by the respective blocks. It should also be noted that the following exemplary procedures may be implemented in a wide variety of environments without departing from the spirit and scope thereof.

Figure 5:
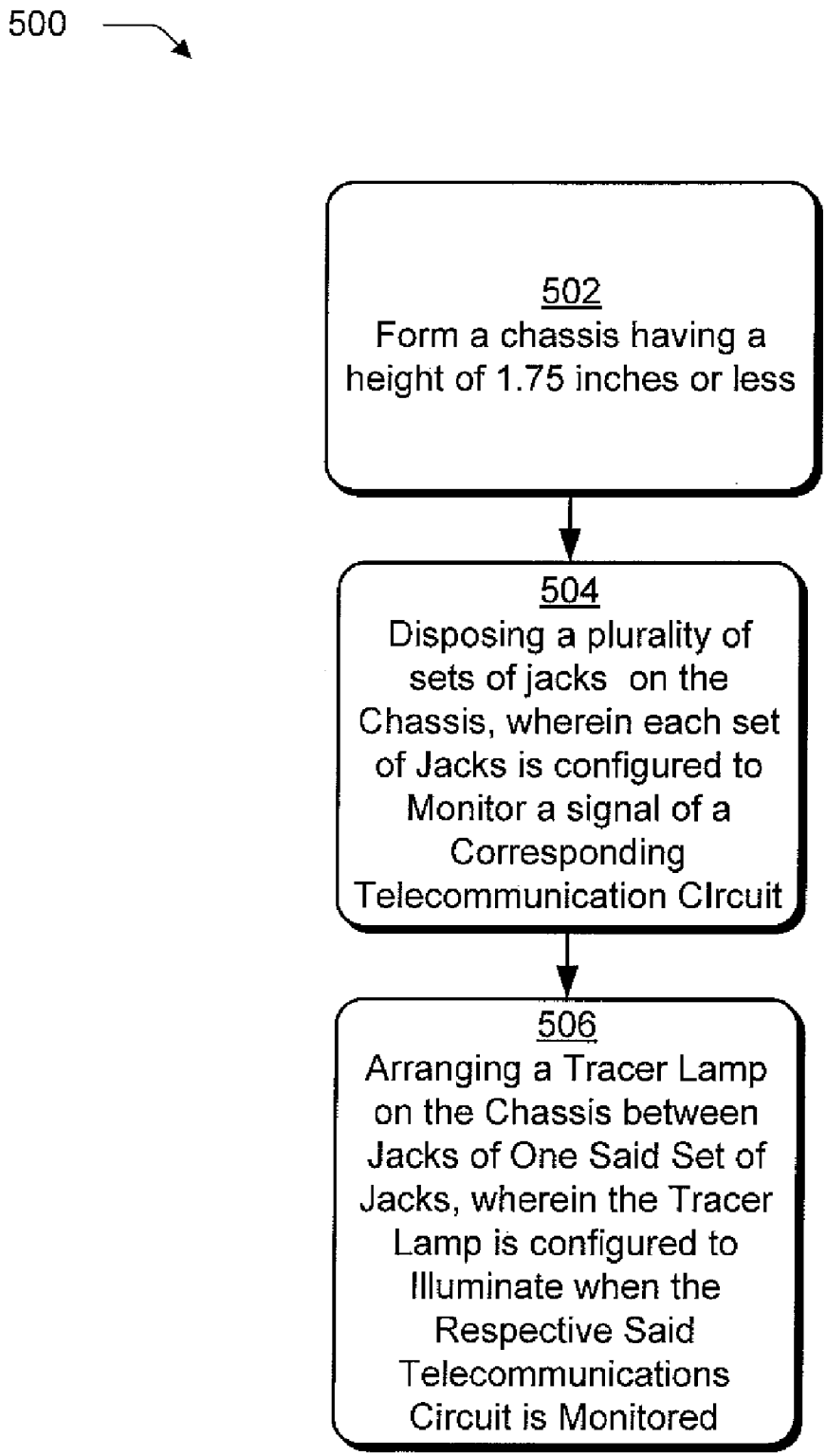
FIG. 5 is a flow diagram depicting a method of forming an exemplary digital cross-connect panel with tracer lamps.

FIG. 5 is a flow diagram depicting a procedure 500 in an exemplary implementation in which a DSX panel with tracer lamps is formed. A chassis is formed having a height of 1.75 inches or less (block 502). For instance, chassis 200 of DSX panel 108(1) depicted in FIG. 2 may be formed. The associated height 212 of chassis 200 may be formed to be less than one rack unit tall.

A plurality of sets of jacks is disposed on the chassis, wherein each set of jacks is configured to monitor a signal of a corresponding telecommunication circuit (block 504). For example, the jacks 206 depicted in FIG. 2 may be disposed on chassis 200. The jacks may be arranged in sets 208(1)-208(m). A plurality of circuits may formed connected to DSX panel 108(1) via the terminations 202 and terminations 204 configured respectively to terminate network elements 110 and make interconnections with other network elements 110, DSX panels 108, and so forth. Each set of jacks 208 may correspond respectively to one of the plurality of telecommunications circuits to provide access to the circuit. For instance, a set of jacks 208 may be communicatively coupled to a respective circuit via panel 108(1).

A tracer lamp is arranged between two jacks of one set of jacks, wherein the tracer lamp is configured to illuminate when the respective telecommunications circuit is monitored (block 506). Continuing the previous example, a tracer lamp 210 may be disposed in between jacks of each set 208 depicted in FIG. 2. Naturally, in other implementations some sets may have tracer lamps 210 while others do not. Each set of jacks 208 provides access to a respective telecommunications circuit as previously described. The tracer lamp 210 disposed between a set of jacks 208 is associated with the same corresponding circuit as the set of jacks. Further, the tracer lamp 210 will illuminate when the circuit is being monitored. The monitoring may be via a jack in the same column or set of jacks 208 with which the tracer lamp 210 is arranged. Alternatively, a second set of jacks 208 associated with the same circuit may be used to perform the monitoring. The second set of jacks 208 may be on the same DSX panel 108(1) or on another DSX panel 108. Thus, the tracer lamp 210 illuminates when monitoring occurs on either side of the circuit.

Conclusion

Although the invention has been described in language specific to structural features and/or methodological acts, it is to be understood that the invention defined in the appended claims is not necessarily limited to the specific features or acts described. Rather, the specific features and acts are disclosed as exemplary forms of implementing the claimed invention.

What is claimed is:

1. A digital cross-connect panel comprising:

a chassis having a height of one rack unit or less;

an array of jacks disposed in sets on the chassis, wherein each said set of jacks provides access to a corresponding telecommunication circuit; and a tracer lamp provided with each said set of jacks to identify the corresponding telecommunication circuit when at least one said jack in the set is used to provide access to the circuit;

wherein each set of jacks includes:

a monitor jack to monitor a signal of a corresponding telecommunications circuit; and an output jack to provide access to an output signal of a network element; and wherein each tracer lamp is disposed between a respective said monitor jack and output jack.

2. The digital cross-connect panel as described in claim 1, wherein each tracer lamp is selected from the group consisting of:

a light emitting diode;

a incandescent lamp; and a fluorescent lamp.

3. The digital cross-connect panel described in claim 1, wherein each jack is selected from the group consisting of:

a bantam style jack;

a mini-WECO style jack;

a WECO style jack;

a modular style jack; and a registered jack (RJ).

4. The digital cross-connect panel described in claim 1, wherein the telecommunications circuits are configured to carry digital signals selected from the group consisting of:

digital service level 1 (DS1) signals;

digital service level 3 (DS3) signals; and ethernet signals.

5. A digital cross-connect panel comprising:

a chassis having a height of one rack unit or less;

a plurality of columns of jacks disposed on the chassis, wherein each column of jacks is associated with a corresponding telecommunication circuit; and a tracer lamp associated with one said column of jacks and configured to identify the corresponding telecommunication circuit, wherein the tracer lamp is disposed on the chassis between two jacks in the column.

6. The digital cross-connect panel as described in claim 5, wherein the one said column of jacks includes a monitor jack to monitor the corresponding telecommunication circuit.

7. The digital cross-connect panel as described in claim 5, wherein each column of jacks provides access to a corresponding telecommunications circuit for monitoring, testing, and patching.

8. The digital cross-connect panel as described in claim 5, wherein each said column of jacks includes a monitor jack, output jack, and an input jack.

9. The digital cross-connect panel as described in claim 8, wherein the tracer lamp is disposed between a monitor jack and an output jack of the associated column.

10. The digital cross-connect panel as described in claim 5, wherein each said telecommunication circuit is formed by the interconnection of a network element connected to the chassis and at least one other network element.

11. The digital cross-connect panel as described in claim 5, wherein the identifying by the tracer lamp occurs when the corresponding telecommunication circuit is accessed by at least one of a respective said column of jacks.

12. The digital cross-connect panel as described in claim 5 further comprising:

a plurality of connection points disposed on the chassis for terminating network elements; and a plurality of terminations disposed on the chassis and configured to interconnect network elements terminated via the plurality of connection points with other network elements in a telecommunication infrastructure to form a plurality of telecommunication circuits.

13. The digital cross-connect panel as described in claim 12, wherein each said column of jacks is communicatively coupled to a respective connection point such that a circuit including a network element terminated at the connection point may be accessed by the column of jacks.

14. The digital cross-connect panel as described in claim 12, wherein the plurality of connection points are provided as terminations selected from the group consisting of:

bifurcated pin terminations;

single post pins;

screw terminals; and insulation displacement connectors.

15. The digital cross-connect panel as described in claim 12, wherein the plurality of connection points is provided by one or more connectors.

* * * * *